US005121764A

United States Patent [19]

Wu

[11] Patent Number: 5,121,764

[45] Date of Patent: Jun. 16, 1992

[54] UMBRELLA HAVING REINFORCED TOP RIB

[75] Inventor: Tsun-Zong Wu, Taipei Hsien, Taiwan

[73] Assignee: Fu Tai Umbrella Works, Ltd., Wu-Ku Hsiang, Taiwan

[21] Appl. No.: 647,233

[22] Filed: Jan. 29, 1991

[51] Int. Cl.[5] ..... A45B 25/00

[52] U.S. Cl. ..... 135/31; 135/32; 403/85

[58] Field of Search ..... 135/29-31, 135/15.1, 32, 25.3-25.34; 403/85

[56] References Cited

U.S. PATENT DOCUMENTS

| | | | |
|---|---|---|---|
| 973,155 | 10/1910 | Woollett | 135/29 X |
| 988,956 | 4/1911 | Whittaker | 135/31 X |
| 1,518,927 | 12/1924 | Hnanicek | 135/31 X |
| 2,167,860 | 8/1939 | Wright | 135/31 X |
| 2,889,841 | 6/1959 | Kampf | 135/31 X |

FOREIGN PATENT DOCUMENTS

| | | | |
|---|---|---|---|
| 4654 | 9/1905 | France | 135/31 |
| 470853 | 4/1952 | Italy | 135/31 |
| 25931 | of 1909 | United Kingdom | 135/31 |

*Primary Examiner*—David A. Scherbel
*Assistant Examiner*—Lan Mai

[57] ABSTRACT

An umbrella includes a plurality of top ribs pivotally secured to a notch formed on an upper end of a central shaft and a plurality of stretcher ribs each pivotally secured between each top rib and a runner slidably held on the central shaft, each top rib being embedded with a reinforcing core rod for strengthening the top rib in order to resist an external force acting upon an umbrella cloth secured on the top ribs.

4 Claims, 5 Drawing Sheets

PRIOR ART

UMBRELLA HAVING REINFORCED TOP RIB

BACKGROUND OF THE INVENTION

A conventional umbrella as shown in FIG. 1 includes: a top rib T pivotally secured to an upper notch N formed on an upper end of a shaft F and a stretcher rib S pivotally secured between the top rib T and a runner R slidably held on the shaft F, in which the rib T may be easily bent downwardly or upwardly if subjected to a strong wind pressure or an external force, thereby breaking or deforming the rib, especially harmful for a larger umbrella used in a beach, a golf course or a storming weather areas.

For reinforcing the rib assembly of another conventional umbrella as shown in FIG. 2, the top rib T may be made with double beams as shown in FIG. 2*a* to greatly increase its strength for overcoming a strong wind pressure or external force. However, the double-beam rib may greatly increase the weight of an umbrella and increase the production complexity and cost of an umbrella.

The present inventor has found the drawbacks of such conventional umbrellas and invented the present umbrella with simply reinforced top ribs in a rib assembly of the umbrella.

SUMMARY OF THE INVENTION

The object of the present invention is to provide an umbrella having a reinforcing core member embedded in each top rib of a rib assembly secured with umbrella cloth for reinforcing a strength of the top rib in order to resist a strong external force acting on an umbrella cloth.

DETAILED DESCRIPTION

Figure 1:
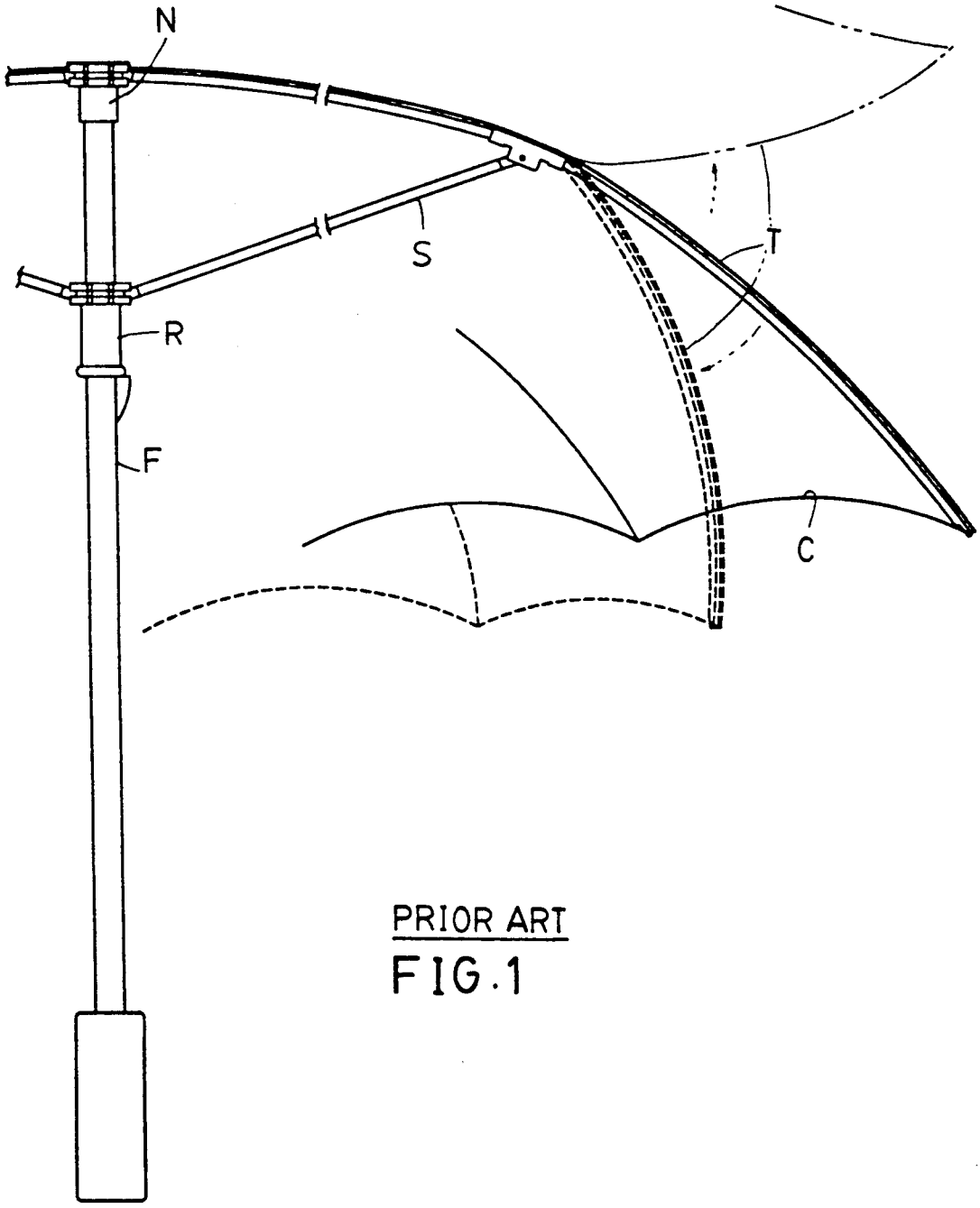
PRIOR ART FIG. 1
FIG. 1 shows a conventional umbrella.
Figures 2, 2A:
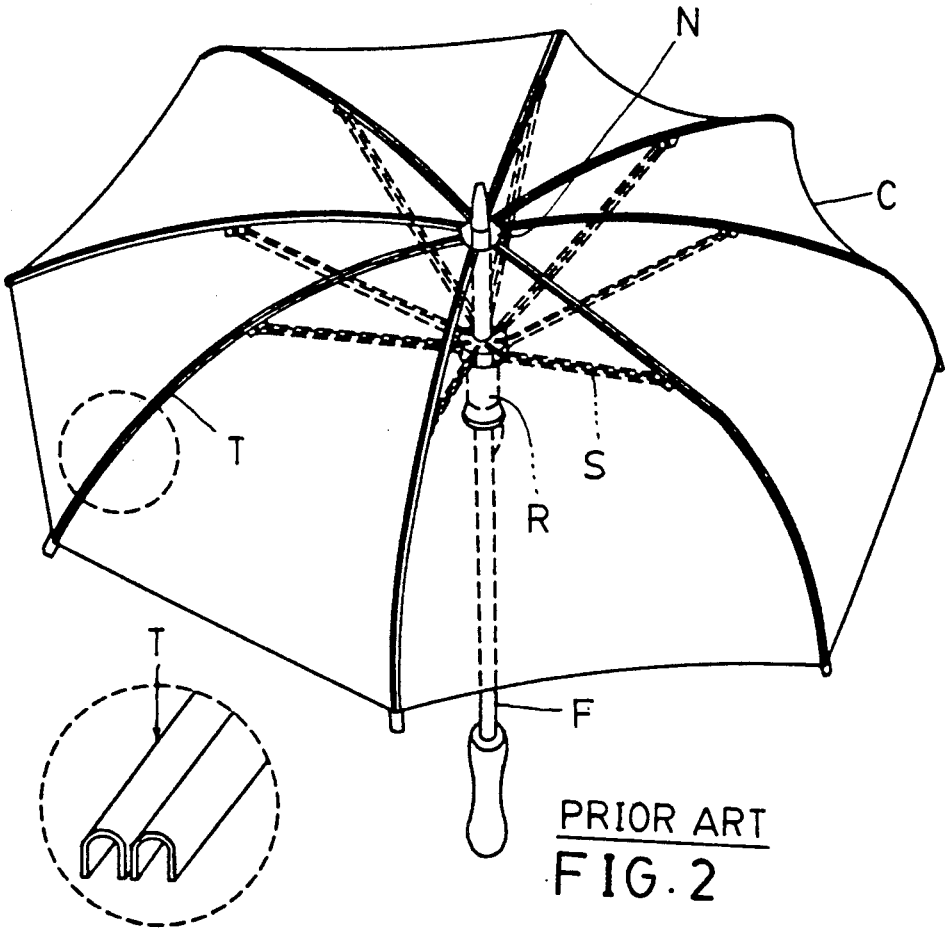
FIG. 2 PRIOR ART
FIG. 2 shows another conventional umbrella.
FIG. 2*a* is a partial illustration showing a double-beam rib of conventional umbrella as shown in FIG. 2.

As shown in FIGS. 3-7, the present invention comprises: a central shaft 1 having an upper notch 12 formed on an upper end of the shaft 1, and a rib assembly 2 secured with umbrella cloth (not shown) thereon including at least a top rib 21 pivotally secured to the notch 12, and at least a stretcher rib 22 pivotally secured between the top rib 21 and a lower runner 11 slidably held on the shaft 1.

Each top rib 21 has an inner end portion 211 pivotally secured to the notch 12, a middle portion 212 of the rib 21 secured with a joint 4 thereon, and an outer end portion 213 opposite to the inner end portion 211.

Each stretcher rib 22 has its inner end portion 211 pivotally secured to the lower runner 11 and has an outer end portion 222 of the rib 22 pivotally secured to the joint 4 fixed on the top rib 21 by a pivot 42.

Figure 7:
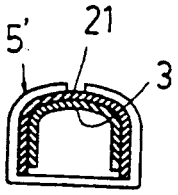
FIG. 7 is a cross-sectional drawing of the present invention as viewed from 7—7 direction of FIG. 3.
Figure 8:
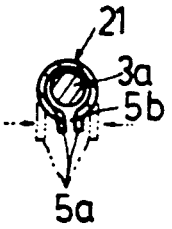
FIG. 8 is a cross-sectional view of another preferred embodiment of the present invention.

A reinforcing core member 3 is embedded in the top rib 21. The core member 3 is made of a longitudinal beam having a cross section generally U-shaped as shown in FIG. 7 or having a cross section of circular shape (3*a*) as shown in FIG. 8. The cross sectional shapes of the core member 3 are not limited in this invention.

The reinforcing core member 3 includes a middle core portion 31 embedded in the middle portion 212 of the top rib 21 and fixed with the joint 4, an inner end portion 32 of the core member 3 retained in an inner retainer means 5 crimped or formed on an inner portion 21*a* of the top rib 21, and an outer end portion 33 of the core member 3 retained in an outer retainer means 5' crimped or formed on an outer portion 21*b* of the top rib 21.

Figure 4:
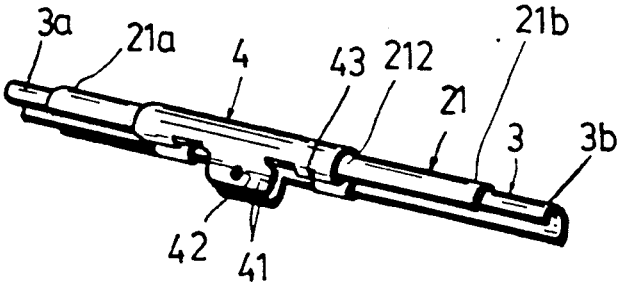
FIG. 4 is a partial perspective view of the present invention.
Figure 5:
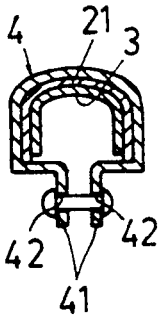
FIG. 5 is a cross-sectional drawing of the present invention when viewed from 5—5 direction of FIG. 3.
Figure 6:
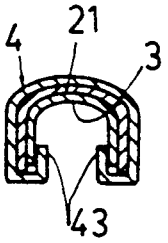
FIG. 6 is a cross-sectional drawing of the present invention as viewed from 6—6 direction of FIG. 3.

As shown in FIGS. 4, 5, 6, the joint 4 includes two lugs 41 protruding downwardly from the joint 4 for pivotally connecting the stretcher rib 22 by a pivot 42, and a pair of crimped clips 43 formed on two opposite sides of the pivot 42 for fastening the top rib 21 with the core member 3. As shown in FIG. 6, each clip 43 is crimped to fixedly fasten the core member 3 having a cross section of U-shape with the top rib 21 having a cross section also U-shaped. If the core member 3 is made of a cylindrical rod having a cross section of circular shape, the clip 43 of the joint 4 may then be directly crimped to firmly clamp the circular-rod core member 3.

As shown in FIG. 7, the retainer means 5' or 5 may be formed as a collar, or a ring having a cross section of generally U-shaped fastened on the top rib 21 having a cross section of generally U-shaped for retaining the core member 3 also having a cross section of generally U-shaped to be slidably held in the top rib 21. As shown in FIG. 8, if the core member 3 is formed as circular rod 3*a*, the retainer means 5 having a cross section of generally U-shaped may be directly formed on the top rib 21 by inwardly pressing two side edge portions of the rib 21 with each other to form two inwardly-pressed ridges 5*a* defining an aperture 5*b* between the two ridges 5*a* to be smaller than a diameter of the core member formed as circular rod 3*a* which will be retained within the U-shaped top rib 21.

Figure 9:
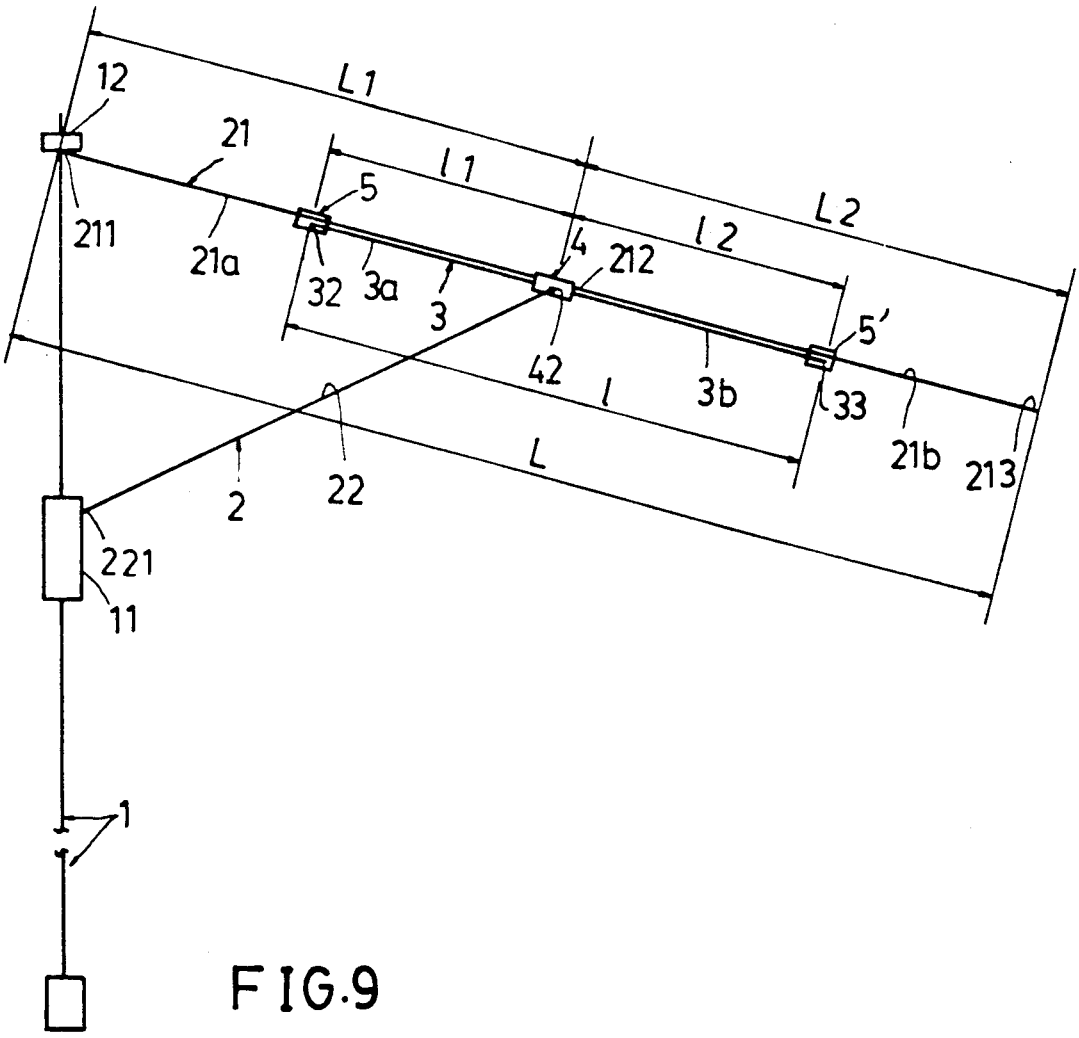
FIG. 9 shows a length relationship between a reinforcing core member and a top rib of the present invention.

If a length of the inner portion 3*a* of the core member 3 is designated as 11 and a length of the outer portion 3*b* of the core member 3 is designated as 12 partitioned from a central pivot 42 as shown in FIG. 9, a length relationship between the core member 3 and the top rib 21 can be formulated as follows:

$$l1 = 4/5\,L1 \ldots 1/5\,L1$$
$$l2 = 4/5\,L2 \ldots 1/5\,L2$$
$$l = l1 + l2 = (4/5\,L1 + 4/5\,L2) \ldots (1/5\,L1 + 1/5\,L2)$$
$$= 4/5\,L \ldots 1/5\,L$$

wherein l is a total length of the core member 3 and L is a total length of the top rib 21 between its inner end portion 211 and outer end portion 213 comprised of a length L1 of an inner portion 21*a* between the central portion 212 (or pivotal 42) and the inner end portion 211, and a length L2 of an outer portion 21*b* between the central portion 212 (or pivot 42) and the outer end portion 213.

Therefore, a length l of the core member 3 is ranging from four-fifths to one-fifth of the length L of the top rib 21, but the length l of the core member 3 is preferably one-third of the length L of the top rib 21. It may increase weight and production cost if the rib 21 is made too long. However, if it is too short, the strength of the rib 21 will become weak.

Figure 3:
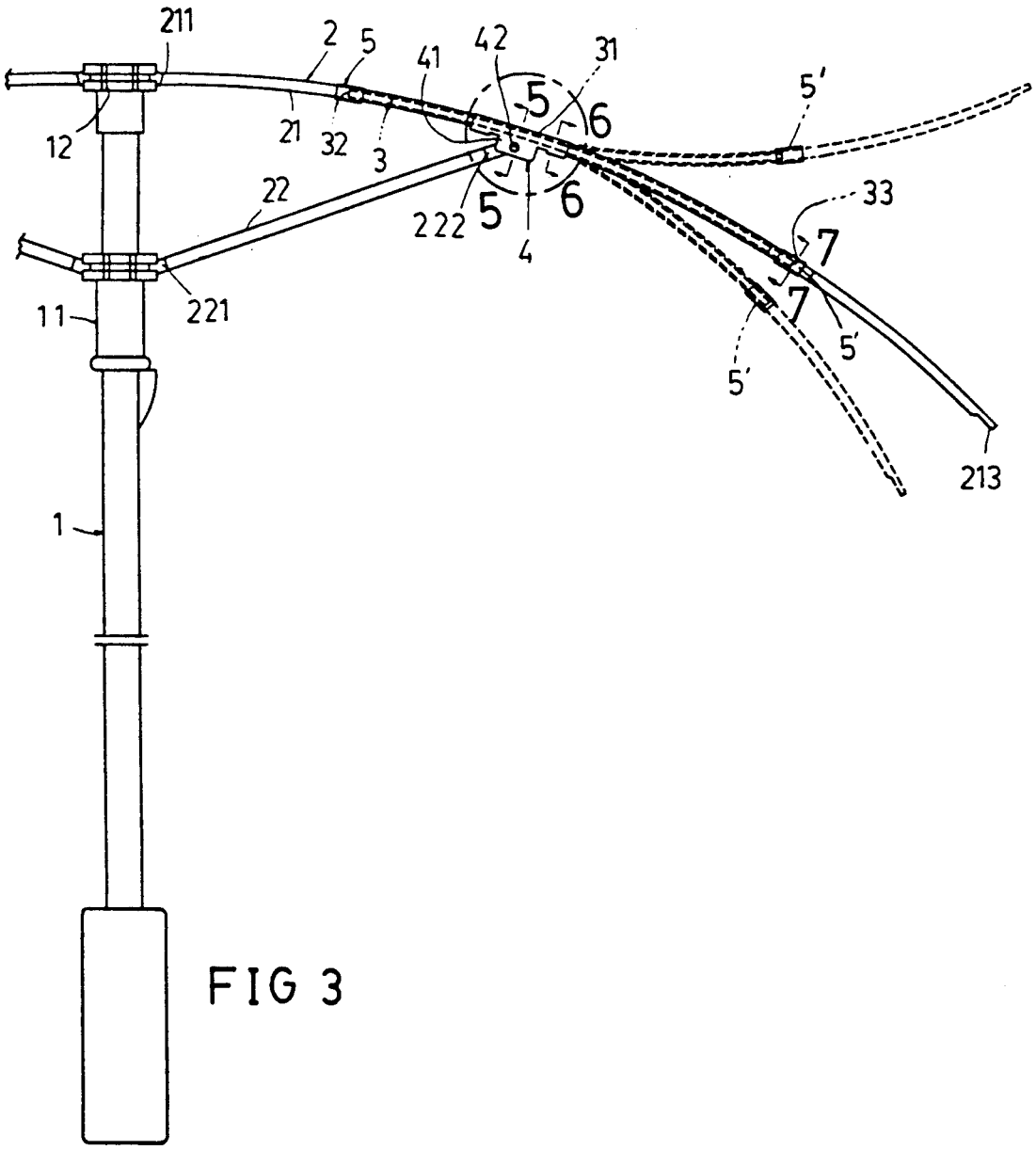
FIG. 3 is an illustration of the present invention.

As shown in FIG. 3, when the rib assembly 2 and the umbrella of the present invention is subjected to an external force such as a strong wind pressure, the top rib 21 secured with the umbrella cloth may be bent either downwardly or upwardly as shown in dotted lines of FIG. 3. However, since each top rib 21 is reinforced by the reinforcing core member 3 in accordance with the present invention, the top rib 21 may only be slightly bent or arcuated with a smoothly bending curve (dotted line shown) as strengthened by the core member 3, without being seriously bent to cause breakage or permanent deformation of the rib 21. Therefore, the present invention provides a reinforcing core member 3, even so simple, which may greatly strengthen the top rib 21 and the rib assembly 2 of an umbrella in order to overcome any external force acting upon the umbrella cloth.

I claim:

1. An umbrella comprising:

a plurality of top ribs of a rib assembly secured with an umbrella cloth thereon pivotally secured to a notch formed on an upper end of a central shaft, each said top rib having an inner portion, an outer portion and a middle portion between said inner and outer portions of the top rib, each said top rib having a cross section of generally U-shaped; and a plurality of stretcher ribs of the rib assembly each said stretcher rib pivotally secured between each said top rib and a runner slidably held on said central shaft;

the improvement which comprises:

each said top rib including a reinforcing core member nested in said top rib; said reinforcing core member having an inner portion, an outer portion and a middle portion between the inner and outer portion of the core member, and having said middle portion of said core member fixedly secured to said middle portion of said top rib, and having said inner end portion of said core member retained in said inner portion of said top rib by an inner retainer means fixed on said inner portion of the top rib and having said outer end portion of said core member retained in said outer portion of said top rib by an outer retainer means fixed on said outer portion of the top rib; said reinforcing core member formed as a longitudinal beam having a cross section of U-shaped nested in said top rib; said top rib having a joint fixed on said middle portion of said top rib for pivotally securing an outer end portion of said stretcher rib by a pivot, said joint including a pair of clips formed on two opposite sides of the pivot respectively crimped on said top rib for fastening said middle portion of said core member.

2. An umbrella according to claim 1, wherein each said retainer means of said inner retainer means and said outer retainer means includes a collar fastened on the top rib for retaining said core member within said top rib.

3. An umbrella according to claim 1, wherein a length of said core member is ranging from four-fifths to one-fifth of a length of said top rib.

4. An umbrella according to claim 3, wherein a length of said core member is preferably one-third of a length of said top rib.

* * * * *